US012733711B2

(12) United States Patent
Elnekaveh

(10) Patent No.: US 12,733,711 B2
(45) Date of Patent: Sep. 15, 2026

(54) ATHLETIC SHOE SOLE

(71) Applicant: Alexander Elnekaveh, Pacoima, CA (US)

(72) Inventor: Alexander Elnekaveh, Pacoima, CA (US)

( * ) Notice: Subject to any disclaimer, the term of this patent is extended or adjusted under 35 U.S.C. 154(b) by 0 days.

(21) Appl. No.: 18/525,711

(22) Filed: Nov. 30, 2023

(65) Prior Publication Data

US 2025/0024913 A1 Jan. 23, 2025

Related U.S. Application Data

(60) Provisional application No. 63/514,297, filed on Jul. 18, 2023.

(51) Int. Cl.

| | |
|---|---|
| ***A43B 13/14*** | (2006.01) |
| ***A43B 7/144*** | (2022.01) |
| ***A43B 13/02*** | (2022.01) |
| ***A43B 13/04*** | (2006.01) |

(52) U.S. Cl.

CPC ..... *A43B 13/141* (2013.01); *A43B 7/144* (2013.01); *A43B 13/026* (2013.01); *A43B 13/04* (2013.01)

(58) Field of Classification Search

CPC ... A43B 13/183; A43B 13/186; A43B 13/188; A43B 13/181; A43B 13/12; A43B 13/026; A43B 7/144; A43B 13/141

See application file for complete search history.

(56) References Cited

U.S. PATENT DOCUMENTS

| | | | | |
|---|---|---|---|---|
| 4,597,196 | A * | 7/1986 | Brown | A43B 7/22 36/43 |
| 4,881,329 | A * | 11/1989 | Crowley | A43B 13/183 36/38 |
| 5,138,776 | A | 8/1992 | Levin | |
| 5,528,842 | A * | 6/1996 | Ricci | A43B 21/30 36/38 |
| 5,577,334 | A * | 11/1996 | Park | A43B 7/142 36/35 R |
| 6,368,989 | B1 * | 4/2002 | Pascual | A43B 7/32 442/13 |
| 6,964,119 | B2 | 11/2005 | Weaver, III | |
| 7,334,351 | B2 * | 2/2008 | Hann | A43B 13/16 36/102 |
| 9,687,042 | B2 * | 6/2017 | Berend | A43B 7/144 |
| 9,907,353 | B2 | 3/2018 | Lester et al. | |
| 9,968,160 | B2 * | 5/2018 | Peyton | A43B 13/183 |
| D869,830 | S | 12/2019 | Lucas et al. | |

(Continued)

FOREIGN PATENT DOCUMENTS

| | | |
|---|---|---|
| CN | 111213958 | 6/2020 |
| CN | 116138541 | 5/2023 |

(Continued)

*Primary Examiner* — Jameson D Collier

(74) *Attorney, Agent, or Firm* — Karthik Murthy; Murthy Patent Law Inc.

(57) ABSTRACT

An athletic shoe sole having an upper midsole, an upper shank, a lower midsole, a lower shank and an outsole is presented. The athletic shoe sole also includes a heel region, an arch region, and a forefoot region. The athletic shoe further sole includes one or more void spaces formed between the upper and lower shanks. The upper and lower shanks acting as springs for the purpose of reducing impact loading and providing energy return during the gait cycle.

11 Claims, 13 Drawing Sheets

(56) References Cited

U.S. PATENT DOCUMENTS

| | | | | |
|---|---|---|---|---|
| 11,122,859 | B2 | 9/2021 | Lee | |
| 11,510,457 | B2 | 11/2022 | Mason | |
| 2003/0005600 | A1* | 1/2003 | Kita | A43B 13/41 36/76 R |
| 2005/0108897 | A1* | 5/2005 | Aveni | A43B 13/187 36/27 |
| 2007/0101617 | A1 | 5/2007 | Brewer et al. | |
| 2007/0256326 | A1* | 11/2007 | Jarvis | A43B 13/226 36/35 R |
| 2008/0250673 | A1* | 10/2008 | Andrews | A43B 13/188 36/25 R |
| 2013/0232826 | A1* | 9/2013 | Bier | A43B 7/08 12/142 V |
| 2014/0259785 | A1* | 9/2014 | Lester | A43B 13/187 36/102 |
| 2014/0331517 | A1* | 11/2014 | Seo | A43B 7/32 36/28 |
| 2015/0047224 | A1 | 2/2015 | Zhao et al. | |
| 2016/0015124 | A1 | 1/2016 | Grell | |
| 2016/0037857 | A1* | 2/2016 | Foxen | A43B 7/1485 36/103 |
| 2019/0289959 | A1* | 9/2019 | Matsui | A43B 13/14 |
| 2020/0305543 | A1* | 10/2020 | Kajiwara | A43B 13/023 |
| 2020/0378462 | A1 | 12/2020 | Rennex | |
| 2022/0232929 | A1 | 7/2022 | Hann | |

FOREIGN PATENT DOCUMENTS

| | | |
|---|---|---|
| CN | 116369608 | 7/2023 |
| CN | 219353133 | 7/2023 |
| WO | 2015138815 | 9/2015 |
| WO | 2021214088 | 10/2021 |

* cited by examiner

ATHLETIC SHOE SOLE

CROSS-REFERENCE TO RELATED APPLICATIONS

This is a utility patent application of U.S. Patent Application No. 63/514,297, filed Jul. 18, 2023 and titled "Dual Shank Athletic Shoe," the contents of which are incorporated by reference herein in their entirety.

BACKGROUND OF THE INVENTION

Field of the Invention

The present invention generally relates to athletic footwear and, more particularly, to footwear that enhances the performance of a wearer by providing increased stability, cushioning and energy return.

Background of the Invention

When running or walking a person's foot transitions through three phases of contact with each stride. Initially, runners and walkers typically strike the ground with their heel. As a result, the heel experiences significant impact loads, which are absorbed by the heel bone. Because this is a dynamic force, the impact load on the heel can be several times the walker or runner's body weight. Furthermore, the impact load is transmitted up the legs to the walker or runner's ankle, knee and hip joints.

The second phase commences when the walker or runner's body weight shifts forward. When the walker or runner's body weight shifts forward, the load in the foot shifts away from the heel towards the middle portion of the foot. In addition, the arch of the foot compresses, with the sole taking the entire weight of the body. Then the foot then rolls toward the metatarsals, which creates a torsional twisting effect due to asymmetrical nature of the foot, including the varying lengths of the toes. This may cause the foot to tilt toward to the inside (medial portion) of the foot or to the outside (lateral portion) of the foot placing additional strains on the joints and ligaments.

As the foot continues to roll forward, the walker or runner's weight is transferred to the forefoot and the metatarsal bones. This stress is distributed across the whole width of the forefoot by the muscles, ligaments, and tendons across the metatarsals.

In an attempt to reduce the impact forces on knees and ankle joints and thereby reduce the risk of injury, current shoe designs typically incorporate multiple layers of foam cushioning, which are believed to reduce impact loads. Foam cushioning material however, tends to degrade and become compacted over time and thereby loses its cushioning effect. Foam cushioning also does little to store and return energy during the gait cycle.

Consequently, there is a need to provide footwear that reduces the risk of injury to the wearer, especially to the wearer's ankle, knee and hip joints, and, ideally, returns energy so as to enhance the wearer's performance while walking or running or engaging in other athletic activities.

SUMMARY OF THE INVENTION

The present invention provides a sole for an athletic shoe, the sole comprising an upper midsole, an upper shank, a lower midsole, a lower shank and an outsole. The upper midsole, lower midsole and outsole each include a heel region and a forefoot region. In the athletic shoe of the present invention the upper shank is disposed between the upper midsole and the lower midsole and typically above a void space or channel formed in the lower midsole. The upper shank, in some embodiments, forms an upper boundary of the void space. The lower shank is disposed between the lower midsole and the outsole and below the void space. In some embodiments, the lower midsole may include multiple void spaces.

In the exemplary embodiments, the upper shank and lower shank are composed of different materials, with the lower shank generally being made of a relatively stiff material such as carbon fiber and the upper shank being made of a relatively flexible material, in comparison to upper shank, such thermoplastic polyurethane ("TPU"). The upper and lower shanks surround the void space in the lower midsole and act similar to a pair of leaf springs to both reduce impact loading at the heel during a foot strike and to return energy as the wearer's foot rolls through the gait cycle.

The upper and lower shanks being disposed above and below the lower midsole, are both stiffer then the midsole material, typically EVA, and therefore tend to oscillate with running or walking motion. That is, the upper and lower shanks move toward each other under the compression of a foot strike with the ground and tend move away from each other when the wearer's foot lifts off the ground during the gait cycle. The void space provides for greater compression and spring-back of the upper and lower shanks than would otherwise be possible if the space between the shanks solely comprised foam cushioning material.

Three principle exemplary embodiments are presented in detail, along several variations. In a first principal embodiment, a single void space, disposed approximately under a wearer's arch is provided. This embodiment provides relatively soft support under a wearer's arch and relatively firm support at the approximate center of pressure of a wearer's heel and at the approximate center of pressure of a wearer's forefoot, i.e. under the balls of a wearer's foot. This configuration is suitable for general athletic shoe use such as walking or running, for field games such as baseball and socker, as well as for numerous court games such as basketball, tennis, pickle ball and the like.

In a second principal embodiment, a single void space, disposed approximately under a wearer's heel is provided. This embodiment provides relatively soft support under a wearer's heel and relatively firm support under a wearer's arch and under the balls of a wearer's foot. This configuration is well-suited for general athletic use where it is desired to have a softer heel strike and additional arch support.

In a third principal embodiment, a single void space is disposed approximately under a wearer's arch and the lower midsole comprises a relatively thick foam cushion. This embodiment provides relatively soft support under a wearer's arch, exceptional cushioning under a wearer's heel and firm support under the balls of a wearer's foot. This embodiment is particularly well-suited for walking and running.

In a fourth principal embodiment, two void spaces are provided. The first void space is located under the approximate center of pressure of a wearer's heel and the second void space is located under approximate center of pressure of a wearer's forefoot, i.e. the balls of a wearer's foot. This embodiment provides relatively soft support under a wearer's heel and the balls of a wearer's foot and relatively firm support under a wearer's arch. This configuration is suitable for general athletic shoe use where a wearer desires relatively firm arch support.

In the exemplary embodiments of the dual-shank athletic shoe of the present invention, the foam cushioning material comprises ethylene-vinyl acetate ("EVA") or like foam materials. In the exemplary embodiments the upper shank is fabricated from TPU or other moderately flexible plastic material. In the exemplary embodiment, the lower shank is fabricated from relatively stiff, but still flexible carbon fiber material. The outsole comprises a rubber outer layer typically having a lug pattern on its external surface optimized to grip and provide ethylene-vinyl acetate traction with the ground. A complete athletic shoe may be provided using the sole designs of the present invention by adding an upper and an insole. Uppers are typically made of fabric or leather or a combination of both. Insoles are typically from a soft foam materials. Suitable designs for shoe uppers and insoles are known in the art.

DETAILED DESCRIPTION OF THE PREFERRED EMBODIMENTS

The present invention will now be described more fully hereinafter with reference to the accompanying drawings, in which preferred embodiments of the invention are shown. The invention may, however, may be embodied in many different forms and should not be construed as being limited to the embodiments set forth herein. Rather these embodiments are provided so that this disclosure will be thorough and complete, and will fully convey the scope of the invention to those skilled in the art. Like numbers refer to like elements throughout.

Figure 1:
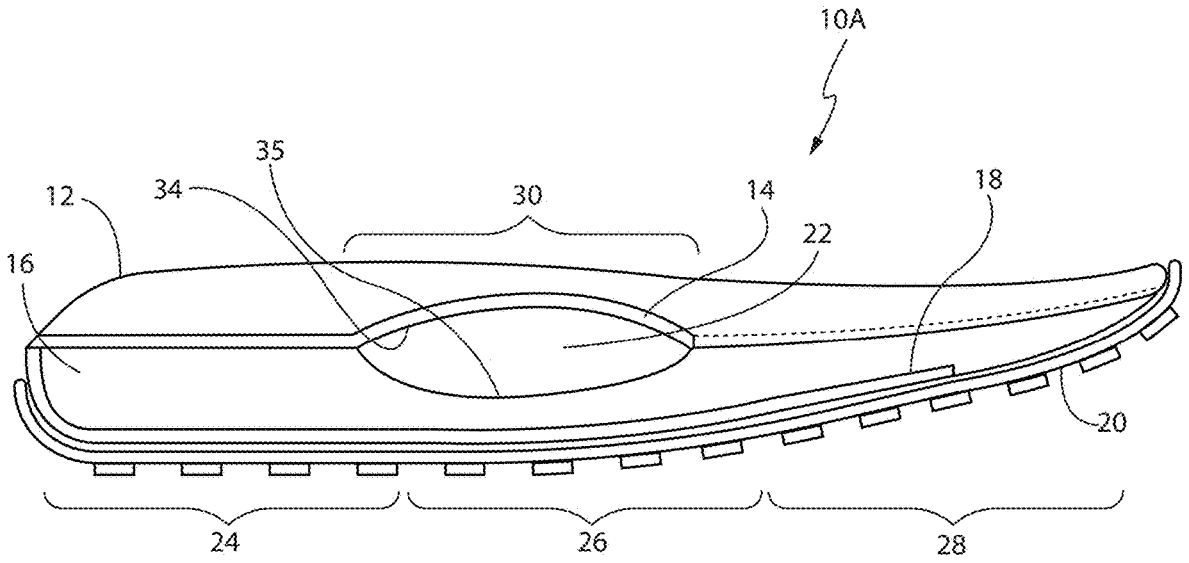
FIG. 1 is an exemplary side view of a first embodiment of the athletic shoe sole of the present invention.
Figure 2:
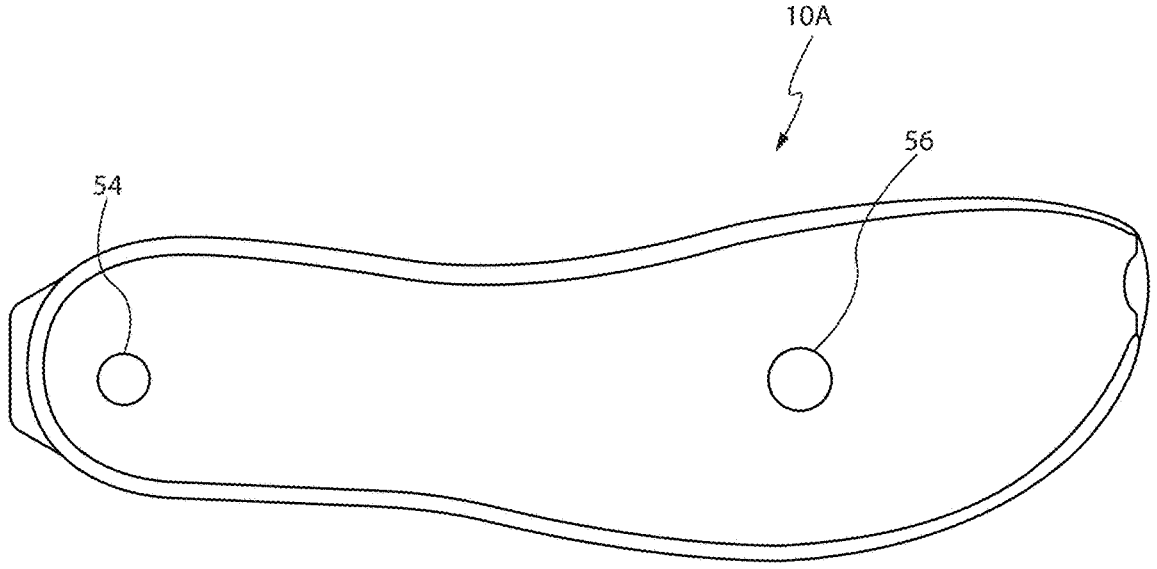
FIG. 2 is an exemplary top view of the athletic shoe sole of FIG. 1.
Figure 3:
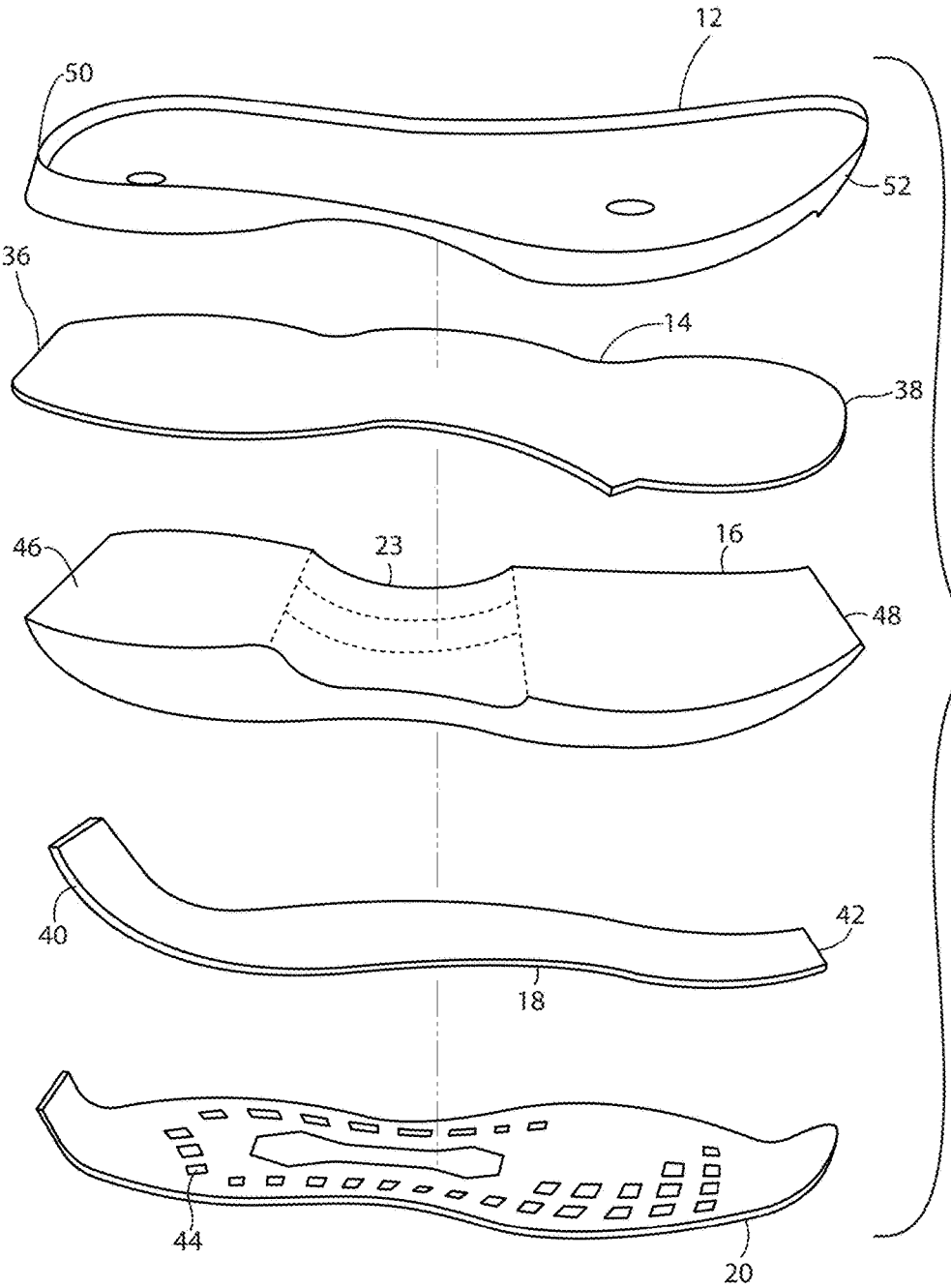
FIG. 3 is an exemplary exploded, perspective view of the athletic shoe sole of FIG. 1.

With reference to FIGS. 1-3, a first embodiment 10A of the athletic shoe sole of the present invention the includes five layers and more specifically an upper midsole 12, an upper shank 14, a lower midsole 16, a lower shank 18 and an outsole 20. The first embodiment 10A of the athletic shoe sole also includes a void space or channel 22 formed between the upper shank 14 and lower shank 18.

The first embodiment 10A of the athletic shoe sole may be divided into approximately three regions, i.e. a heel region 24, an arch region 26 and a forefoot region 28. The athletic shoe sole 10 further has an approximate heel center of pressure 54 which corresponds to the approximate center of pressure of a wearer's heel and an approximate forefoot center of pressure 56 that corresponds to the approximate center of pressure of the balls of a wearer's foot.

The upper midsole 12 has an aft end 50 and a forward end 52. The lower midsole 16 has an aft end 46 and a forward end 48 and includes a relieved area 23, which forms the void space 22, which is located in the arch region 26 of the athletic shoe sole 10. The void space 22 has a length 30 that corresponds approximately to the length of a wearer's arch and a width which corresponds approximately to the width of the lower midsole. Suitable materials for the upper midsole 12 and the lower midsole 16 include ethylene-vinyl acetate ("EVA") or like soft foam materials.

The upper shank 14 has an aft end 36 and a forward end 38 and is disposed between the upper midsole 12 and the lower midsole 16, A concave portion 34 of the upper shank 14 forms a concave upper boundary or surface of the void space 22 The lower midsole 16 includes a convex surface 35, which forms a convex lower boundary or surface of the void space 22. The lower shank 18 has an aft end 40 and a forward end 42 is disposed between the lower midsole 16 and the outsole 20. In the exemplary first embodiment 10A the athletic shoe sole, the aft end 36 of the upper shank 14 is connected to the aft end 40 of the lower shank 18 to provide flexing between the shanks during a gait cycle while walking or running. The aft ends of the shanks need not be connected, however. In the exemplary first embodiment 10A of the athletic shoe sole, the forward end 38 of the upper shank 14 is not connected to the forward end 42 of the lower shank 18. The outsole 20 comprises a durable rubber outer layer typically having a lug pattern 44 on its external surface optimized to grip and provide traction with the ground.

In the exemplary first embodiment 10A of the athletic shoe sole of the present invention, it is preferred that the lower shank be stiffer than the upper shank as this configuration is believed to provide superior energy return characteristics. Achieving a particular stiffness for a shank may be accomplished through a combination of material choice and/or shank thickness. In the exemplary embodiment of the athletic shoe sole 10, the upper shank 14 and lower shank 18 are composed of different materials, with the lower shank 18 being fabricated from carbon fiber and the upper shank 14 being fabricated from thermoplastic polyurethane ("TPU"). In general, suitable materials for the upper shank 14 and lower shank 18 include thermoplastic polyurethane ("TPU") and like plastic materials, as well as carbon fiber and metallic materials with spring properties such as a variety of steel alloys.

The upper shank 14 and the lower shank 18 surround the void space 22 in the lower midsole 16 and thereby act similar to a pair of springs to both reduce impact loading at the heel during a foot strike and to return energy as the wearer's foot rolls through the gait cycle. The upper and lower shanks 14 and 18 are both configured to be stiffer then the lower midsole 16 which is comprised of a relatively soft, shock absorbing foam material such as EVA. Therefore, the upper and lower shanks 14 and 18 tend to oscillate with running or walking motion. That is, the upper and lower shanks 14 and 18 move toward each other under the compression of a foot strike with the ground and tend move away from each other when the wearer's foot lifts off the ground during the gait cycle. In the void space 22, no damping of the oscillating motion of the upper and lower shanks 14 and 18 occurs which provides for both greater compression and spring-back of the upper and lower shanks than would otherwise be possible if the space between the shanks solely comprised foam cushioning material.

During manufacturing, the five layers which comprise the first embodiment 10A athletic shoe sole of the present invention, i.e. the upper midsole 12, upper shank 14, lower midsole 16, lower shank 18 and the outsole 20 are bonded together to form a unitary sole. Materials and methods for bonding shoe layers are known in the art.

With continued reference to FIGS. 1-3, in the first embodiment 10A of the athletic shoe sole of the present invention, the void space 22, being disposed in the arch region 26 of the first embodiment 10A of the athletic shoe sole, provides relatively soft support under a wearer's arch and relatively firm support at the heel center of pressure 54 which corresponds to the approximate center of pressure of a wearer's heel and at the approximate forefoot center of pressure 56 which corresponds to the approximate center of pressure of the balls of a wearer's foot. This configuration is suitable for general athletic shoe use such as walking or running, for field games such as baseball and soccer, as well as for numerous court games such as basketball, tennis, pickle ball and the like.

A complete athletic shoe may be provided using the first embodiment 10A of the athletic shoe sole design of the present invention by adding an upper 58 and, typically, an insole 60 (not shown). Uppers are typically made of fabric or leather or a combination of both. Insoles are typically made from soft foam materials. Suitable designs for shoe uppers and insoles are known in the art.

Figure 4:
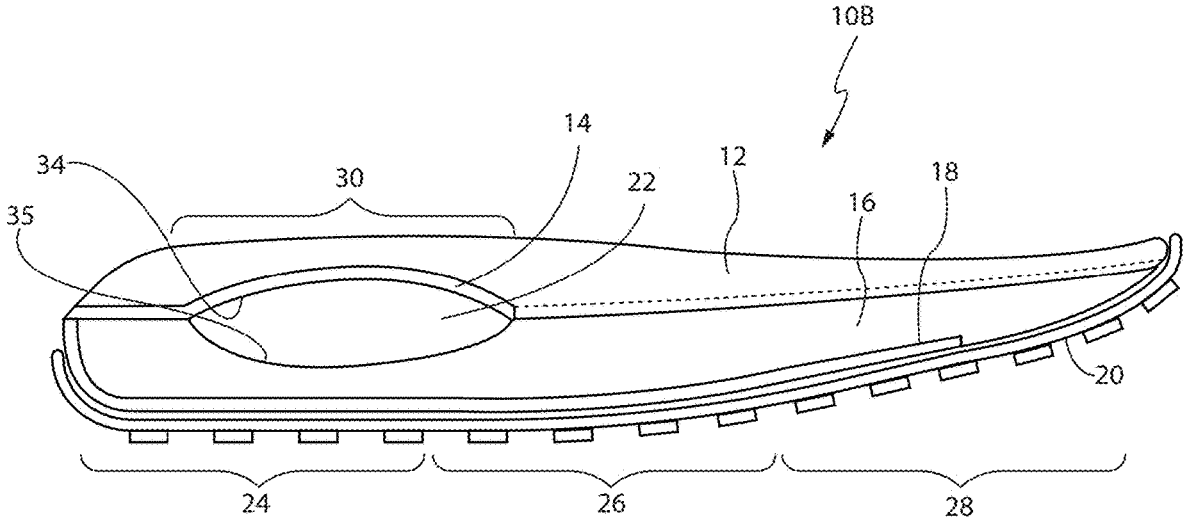
FIG. 4 is an exemplary side view of a second embodiment of the athletic shoe sole of the present invention.
Figure 5:
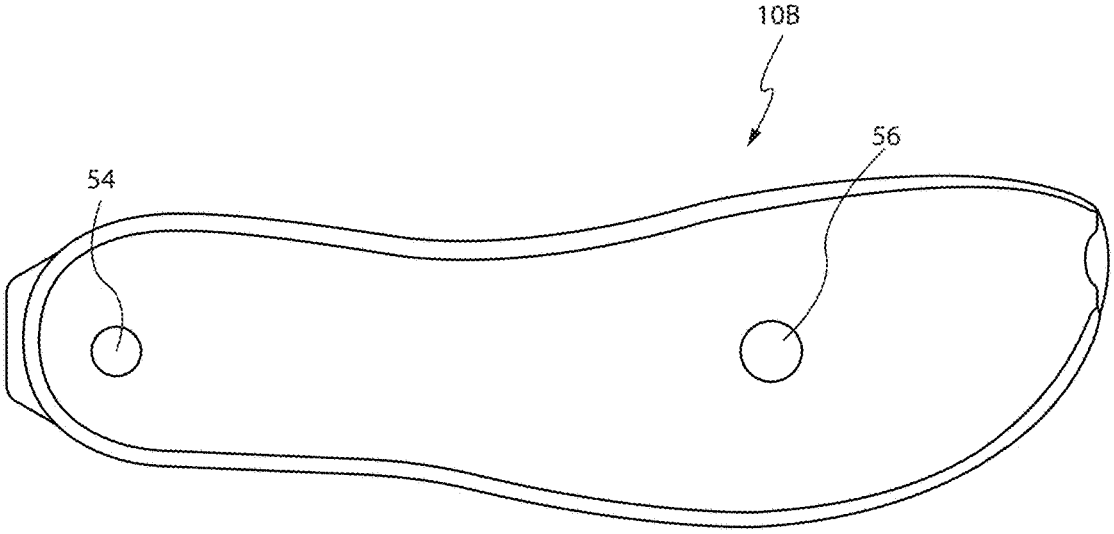
FIG. 5 is an exemplary top view of the athletic shoe sole of FIG. 4.
Figure 6:
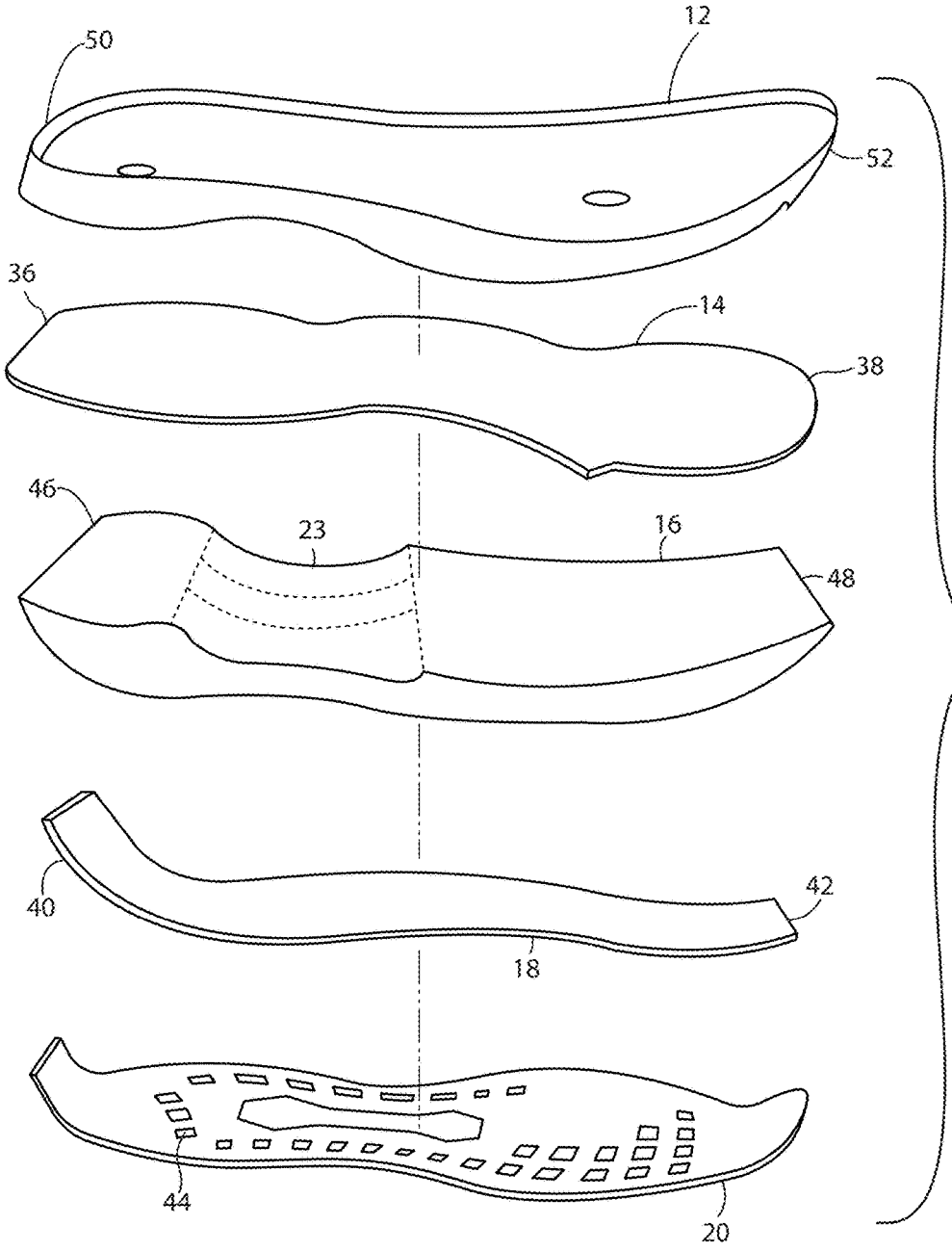
FIG. 6 is an exemplary exploded, perspective view of the athletic shoe sole of FIG. 4.

With reference to FIGS. 4-6, a second embodiment 10B of the athletic shoe sole of the present invention is depicted. The second embodiment 10B of the athletic shoe sole includes the five layer design and features of the first embodiment 10A of the athletic shoe sole of FIG. 1, with the exception that the void space 22 has been repositioned from under a wearer's arch to under the wearer's heel. That is the void space 22 has been repositioned from the arch region 26 of the sole to the heel region 24 of the sole. This change provides the second embodiment 10B of the athletic shoe sole with relatively soft support under a wearer's heel and relatively firm support under a wearer's arch in contrast to the first embodiment 10A of the athletic shoe sole. This configuration is well-suited for general athletic use where it is desired to have a soft heel strike and additional arch support.

Figure 7:
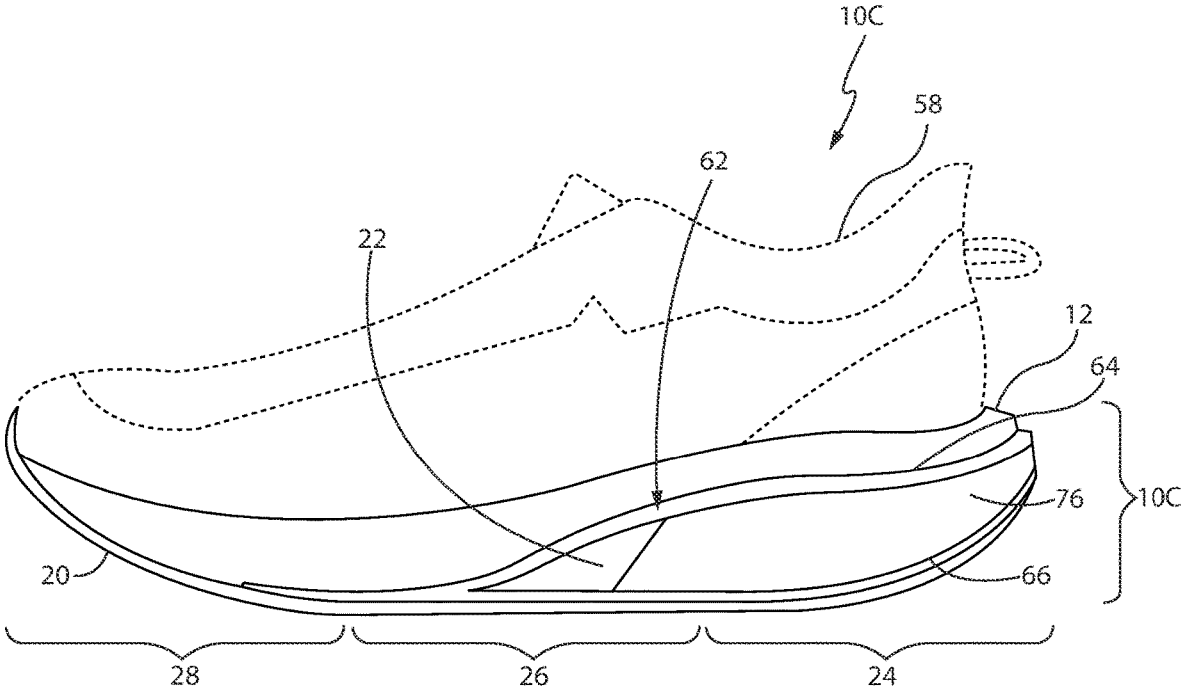
FIG. 7 is an exemplary side view of a third embodiment of the athletic shoe sole of the present invention.
Figure 8:
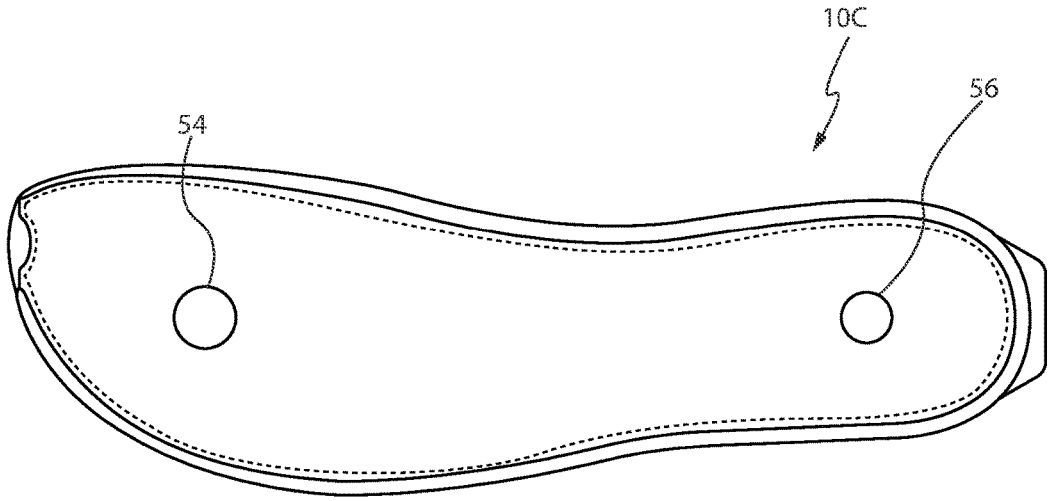
FIG. 8 is an exemplary top view of the athletic shoe sole of FIG. 7.
Figure 9:
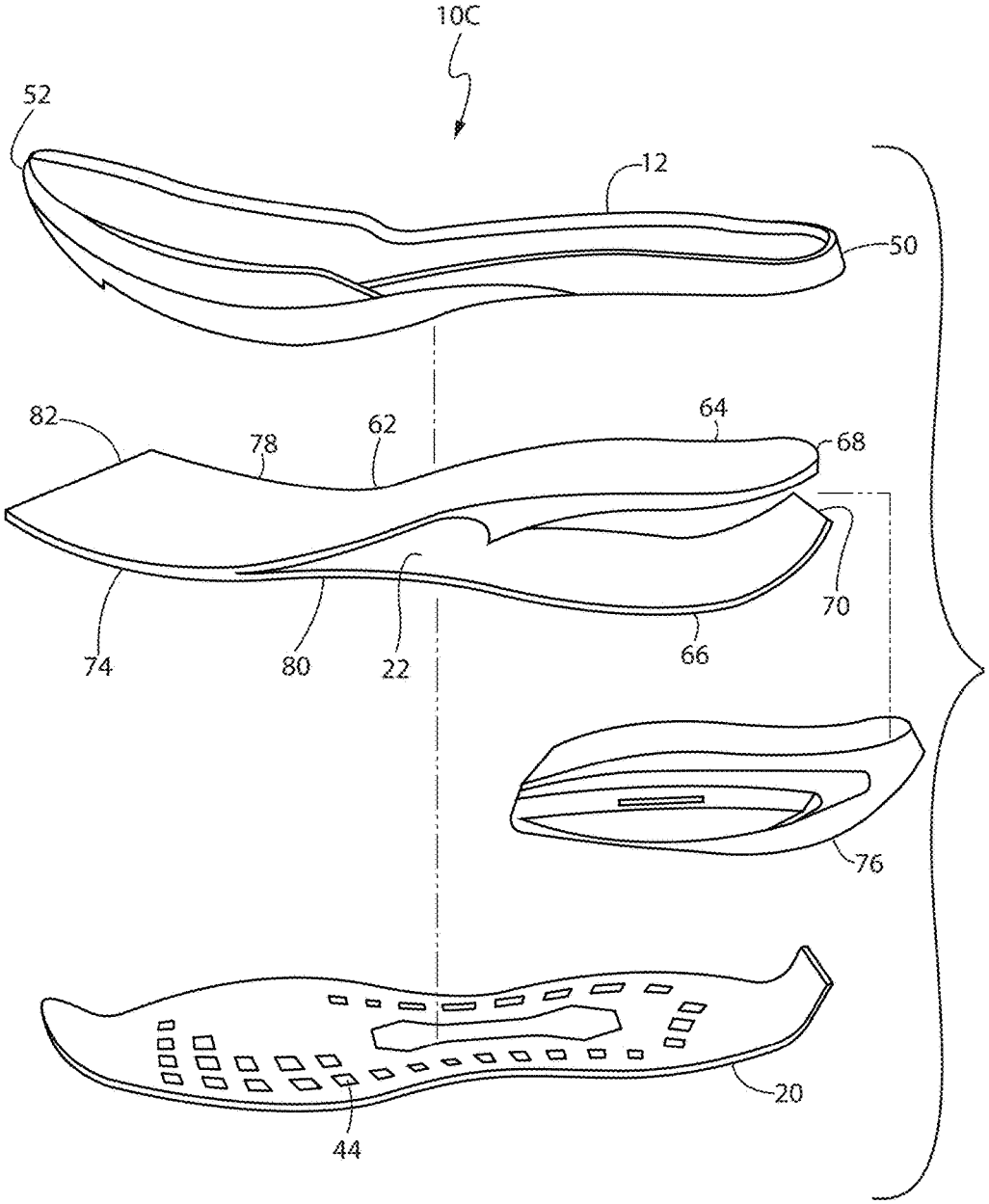
FIG. 9 is an exemplary exploded, perspective view of the athletic shoe sole of FIG. 7.

With reference to FIGS. 7-9, a third embodiment 10C of the athletic shoe sole of the present invention is depicted. The third embodiment 10C of the athletic shoe sole includes a five component design, but one that differs in physical configuration in certain respects from the first and second embodiments 10A and 10B of the athletic shoe sole. More specifically, the third embodiment 10C of the athletic shoe sole includes the upper midsole 12, a split-shank 62, a heel pad 76 and the outsole 20. The third embodiment 10C of the athletic shoe sole may be divided into approximately three regions, i.e. a heel region 24, an arch region 26 and a forefoot region 28. The third embodiment 10C athletic shoe sole further has an approximate heel center of pressure 54 which corresponds to the approximate center of pressure of a wearer's heel and an approximate forefoot center of pressure 56 that corresponds to the approximate center of pressure of the balls of a wearer's foot.

The upper midsole 12 has an aft end 50 and a forward end 52. The split-shank 62 is dual spring like structure that includes an upper shank portion 64 and a lower shank portion 66. The upper shank portion 64 has a free aft end 68 and a forward end 78. The lower shank portion 66 has a free aft end 70 and a forward end 80. The forward ends 78 and 80 of the upper and lower shank portions 64 and 66 blend or join to form a single forefoot shank portion 74 having a forward end 82. In the exemplary embodiment, the split-shank 62 is a molded component and consequently the upper shank portion 64 and lower shank portion are made from the same material. The relative stiffness of the upper and lower shank portions 64 and 66 may be varied by changing the thickness of each shank portion. The split-shank 62 allows the upper shank portion 64 to flex relative to other portions of the upper shank portion 64 during the gait cycle while walking or running. Similarly, the split-shank 62 allows the lower shank portion 66 to flex relative to other portions of the lower shank portion 66 during the gait cycle while walking or running. Although the split-shank 62 is formed as a unitary component molded of a single material, each of the upper and lower shank portions 64 and 66 could alternatively be made as separate components from separate materials and bonded together at the forefoot shank portion 74.

With continued reference to FIGS. 7-9, the third embodiment 10C of the athletic shoe sole includes a void space 22 disposed under in the arch region 26 of the sole. The upper shank portion 64 forms an upper boundary for the void space 22 and the lower shank portion 66 forms a lower boundary for the void space 22. The void space 22 is closed out at an aft end by the heel pad 76, which is disposed between the upper and lower shank portions 64 and 66 in the heel region 24 of the third embodiment 10C of the athletic shoe sole.

The void space 22 is located approximately under a wearer's arch in the arch region 26 of the third embodiment 10C of the athletic shoe sole.

Suitable materials for the split-shank 62 include TPU and like plastic materials, as well as carbon fiber and metallic materials with spring properties such as a variety of steel alloys. Suitable materials for the upper midsole 12 and heel pad 76 include EVA and like plastic foam materials. The outsole 20 comprises a durable rubber outer layer typically having a lug pattern 44 on its external surface optimized to grip and provide traction with the ground.

With continued reference to FIGS. 7-9, the upper and lower shank portions 64 and 66 are configured to be stiffer then the heel pad 76, which is comprised of EVA or other relatively soft, shock absorbing material. Therefore, the upper and lower shank portions 64 and 66 tend to oscillate with running or walking motion. That is, the upper and lower shank portions 64 and 66 move toward each other under the compression of a foot strike and tend move away from each other when the wearer's foot lifts off the ground during the gait cycle while walking or running. The void space 22 provides no damping of the oscillating motion of the upper and lower shank portions 64 and 66 which provides for both greater compression and spring-back of the upper and lower shank portions than would otherwise be possible if the space between the shank portions solely comprised cushioning material.

During manufacturing, the components which comprise the third embodiment 10C of the athletic shoe sole of the present invention, i.e. the upper midsole 12, the split-shank 62, the heel pad 76 (disposed between the upper and lower shank portions 64 and 66) and the outsole 20 are bonded together to form a unitary sole. Materials and methods for bonding shoe layers are known in the art.

The heel pad 76 of the third embodiment 10C of the athletic shoe sole comprises a relatively thick foam cushion. Therefore, this embodiment provides exceptional cushioning and shock absorption during heel strikes which make this embodiment particularly well-suited for running and general high-impact activities.

Figure 10:
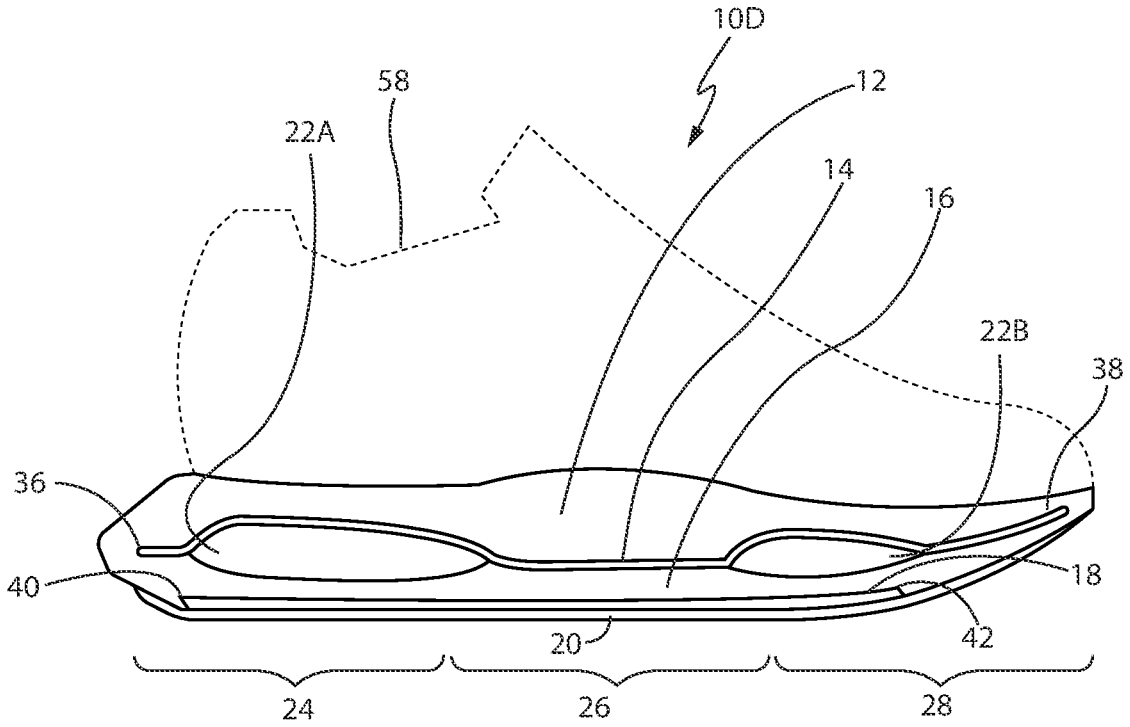
FIG. 10 is a representational side view of a fourth embodiment of the athletic shoe of the present invention having two void spaces.

With reference to FIG. 10, a fourth embodiment 10D of the athletic shoe sole of the present invention is depicted. This embodiment is similar to the first and second embodiments 10A and 10B of the athletic shoe sole and features a similar five layer design. The fourth embodiment 10D of the athletic shoe sole differs from the first and second embodiments 10A and 10B in that it features two void spaces and, in particular, a heel void space 22A disposed approximately under a wearer's heel and a forefoot void space 22B disposed approximately under the balls of a wearer's foot. The first and second embodiments 10A and 10B of the athletic shoe sole by contrast featured only a single void space, i.e. under a wearer's arch in the case of the first embodiment 10A and under a wearer's heel in the case of second embodiment 10B.

A further difference of the fourth embodiment 10D is that the aft end 36 of the upper shank 14 does not contact the aft end 40 of the lower shank 18. Rather the upper and lower shanks 14 and 18 remain separated from each other by the lower midsole 16. Like the first embodiment 10A, in the fourth embodiment 10D, the upper and lower shanks 14 and 18 are separated at their forward ends 38 and 42.

For reference, like the first and second embodiments 10A and 10B, the five layers of the fourth embodiment 10D are the upper midsole 12, upper shank 14, lower midsole 16, lower shank 18 and outsole 20. A heel void space 22A is disposed approximately under a wearer's heel and a forefoot void space 22B is disposed under the balls of a wearer's foot. The upper shank 14 forms an upper boundary of the heel void space 22A and the forefoot void space 22B. During manufacturing, the layers that comprise the fourth embodiment 10D of the athletic shoe sole are bonded together to form a unitary sole.

The heel and forefront void spaces 22A and 22B provide the fourth embodiment 10D of the athletic shoe sole with relatively soft support under both a wearer's heel and the balls of a wearer's foot and firmer support under a wearer's arch. This configuration is well-suited for general athletic shoe use.

Figure 11:
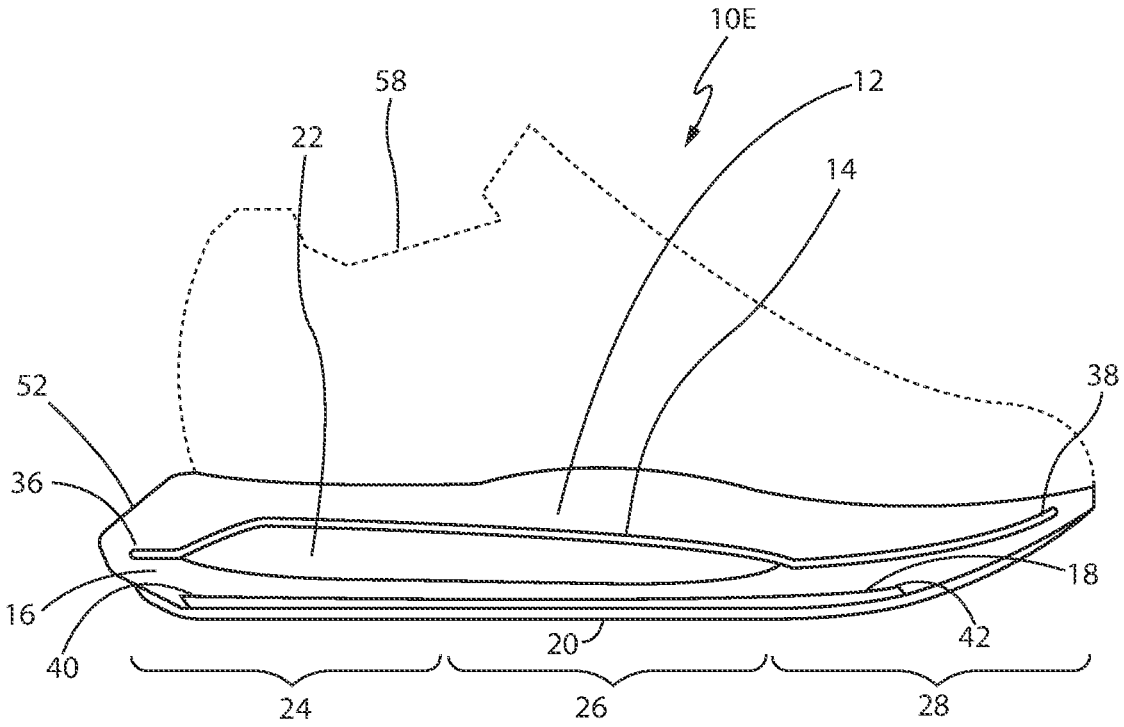
FIG. 11 is a representational side view of a fifth embodiment of the athletic shoe of the present invention having a single, elongated void space.

With reference to FIG. 11, a fifth embodiment 10E of the athletic shoe sole of the present invention is depicted. The fifth embodiment 10E is similar to the first embodiment 10A and features a similar five layer construction. The fifth embodiment 10E differs from the first embodiment 10A in it features a single, elongated void space 22, that spans the approximate length of the heel region 24 and arch region 26 of the sole. In contrast, the void space 22 of the first embodiment 10A disposed approximately under a wearer's heel and spanned approximately only the arch region 26 of the sole.

A further difference of the fifth embodiment 10E is that the aft end 36 of the upper shank 14 does not contact the aft end 40 of the lower shank 18. Rather the upper and lower shanks 14 and 18 remain separated from each other by the lower midsole 16. Like the first embodiment 10A, in the fourth embodiment 10D, the upper and lower shanks 14 and 18 are separated at their forward ends 38 and 42.

For reference, like the first embodiment 10A, the five layers of the fifth embodiment 10E are the upper midsole 12, upper shank 14, lower midsole 16, lower shank 18 and outsole 20. The single, elongated void space 22 is disposed under a wearer's heel and arch. The upper shank 14 forms an upper boundary of the elongated void space 22. During manufacturing, the layers that comprise the fifth embodiment 10E of the athletic shoe sole are bonded together to form a unitary sole.

The single, elongated void space 22 of the fifth embodiment 10E of the athletic shoe sole provides relatively soft support under both a wearer's heel and arch. This configuration is suited for general athletic shoe use. A complete athletic shoe may be provided by adding an upper 58 and typically in an insole 60 (not shown) to the fourth embodiment 10D of the athletic shoe sole of the present invention. Suitable designs for shoe uppers and insoles are known in the art.

Figure 12:
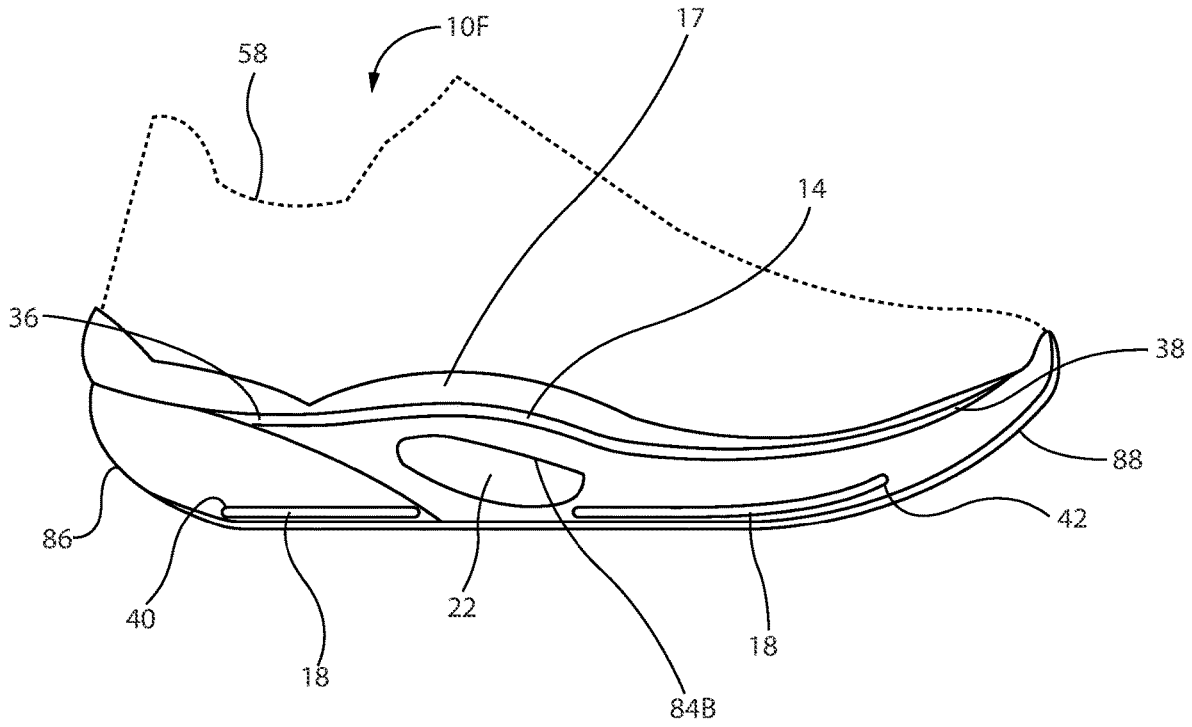
FIG. 12 is a representational side view of a sixth embodiment of the athletic shoe sole of the present invention, having a single void space and an alternative shank configuration.

In FIGS. 12-20, discussed below, alternative void space and shank configurations are presented. With reference to FIG. 12, a sixth embodiment 10F of the athletic shoe sole of the present invention is shown. In the sixth embodiment, the shape of the void space 22 is formed in a midsole 17 and is defined by multiple, irregular curves. The upper shank 14 is disposed above the void space 22 and runs continuously from about a rear end 86 of the sole to a front end 88. The upper shank 14 does not form part of the upper wall surface of the void space. The lower shank 18 is disposed below the void space 22 but is discontinuous in the area directly under the void space 22. Separation is maintained between the upper and lower shanks 14 and 18 throughout the length of the sole. The shank configuration of the sixth embodiment 10F of the athletic shoe sole tends to provide more flexibility in the region immediately under the void space 22 in comparison to a lower shank that extends continuously along the length of the shoe.

Figure 13:
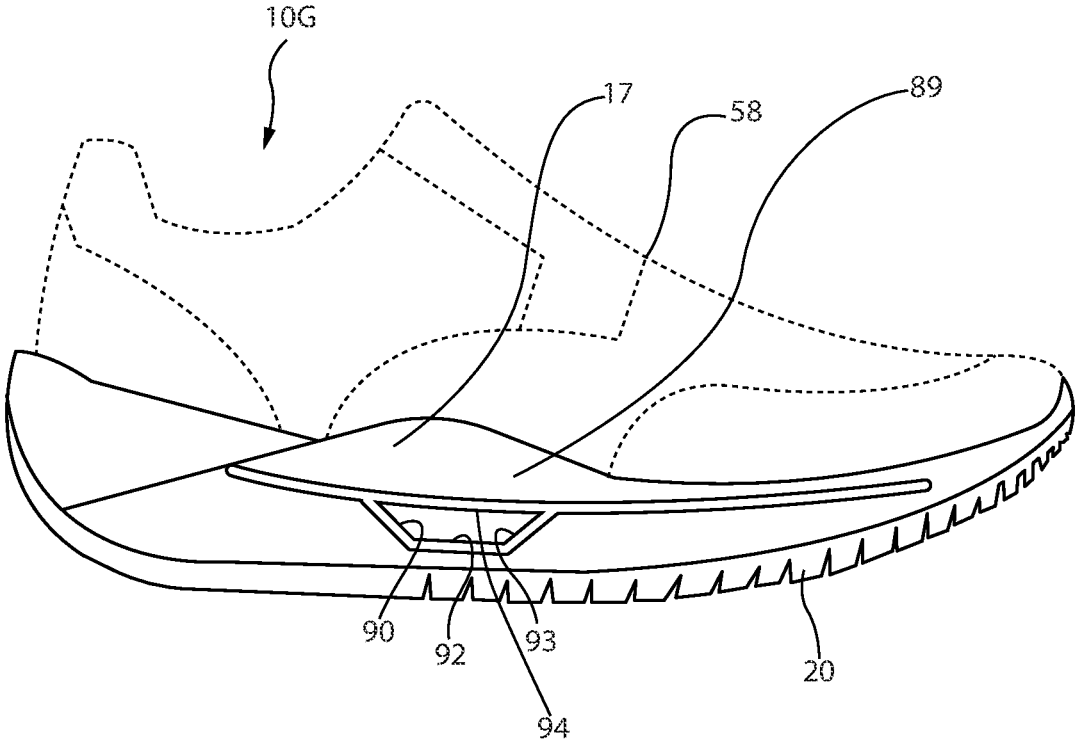
FIG. 13 is a representational side view of a seventh embodiment of the athletic shoe sole of the present invention having a single void space and an alternative shank configuration.

With reference to FIG. 13, a seventh embodiment 10G of the athletic shoe sole of the present invention is presented. In the seventh embodiment 10G, the void space 22 is formed in the midsole 17 and is generally in the shape of a quadrilateral. Surrounding the void space 22 is a first embodiment of an internal support element 89. The internal support element 89 comprises an upper shank element 94, an aft lower shank side element 90, a lower shank bottom element 92, and, a forward lower shank side element 93. This configuration allows the internal support element 89 to flex between upper shank element 99 and lower shank elements 90, 92 and 93 during gait cycle while running or walking. The configuration of the seventh embodiment 10G of the athletic shoe sole tends to provide additional support in the region immediately under the void space 22.

Figure 14:
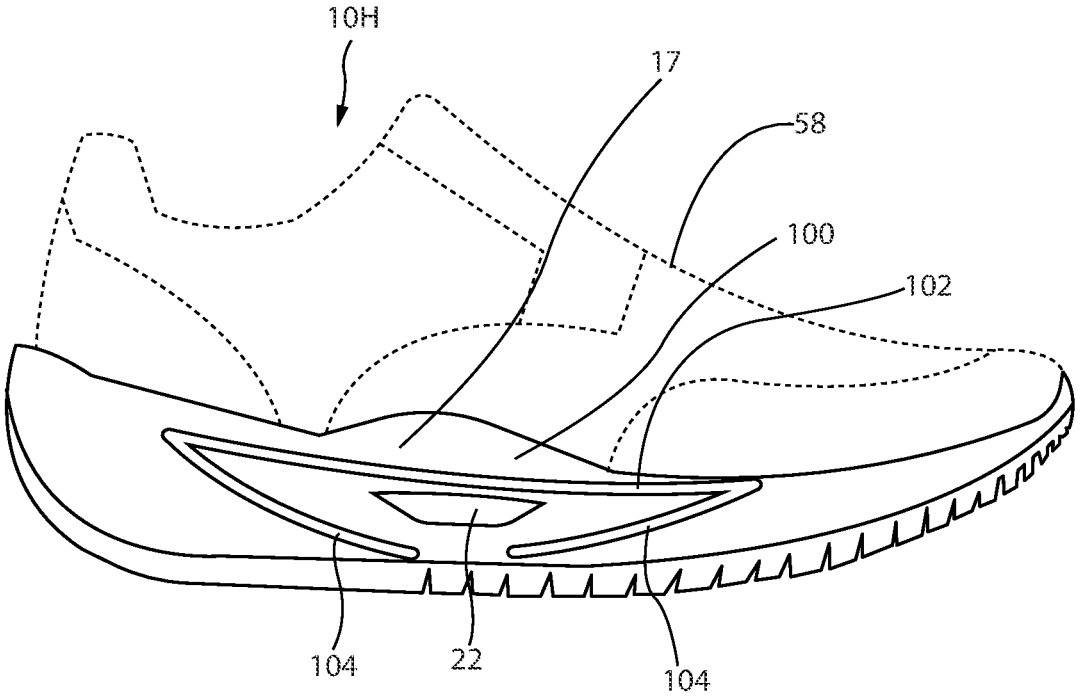
FIG. 14 is a representational side view of an eighth embodiment of the athletic shoe sole of the present invention having a single void space and an alternative shank configuration.

With reference to FIG. 14, an eighth embodiment 10H of the athletic shoe sole is presented. In the eighth embodiment 10H, the void space 22 is formed in the midsole 17 and the shape of the void space is that of an irregular quadrilateral. The void space 22 is surrounded by a second embodiment of an internal support element 100, which comprises an upper shank midportion 102, an aft curving side element 104 and a forward curving side element 106. This configuration allows the second embodiment of the internal support element 100 to flex between the upper shank midportion 102 and the aft curving side element 104 and the forward curving side element 106 during the gait cycle while running or walking. The configuration of the eighth embodiment 10H of the athletic shoe sole provides additional support in the region immediately under the void space 22. This arrangement provides a variable stiffness or flexibility characteristic to the eighth embodiment 10H of the athletic shoe sole.

Figure 15:
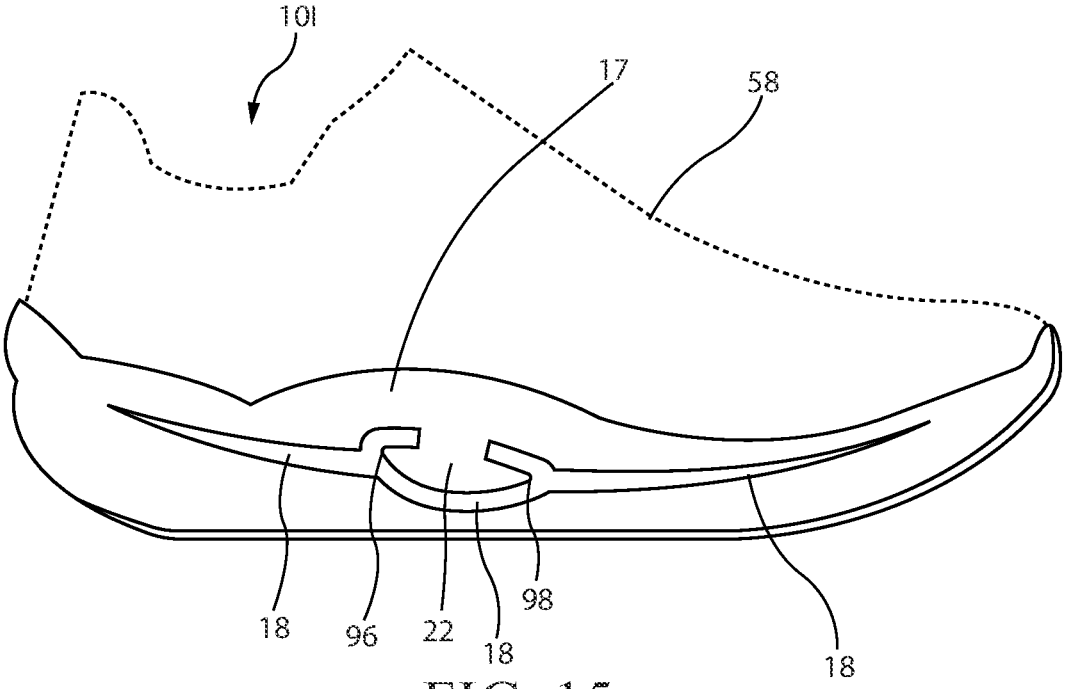
FIG. 15 is a representational side view of a ninth embodiment of the athletic shoe sole of the present invention having a single void space and an alternative shank configuration.

With reference to FIG. 15, a ninth embodiment 10I of the athletic shoe sole of the present invention is presented. In this embodiment, the void space 22 is formed in the midsole 17 and its shape in defined by multiple, irregular curves. The upper shank 14 is disposed above the void space 22 and forms a partial upper boundary of the void space as the upper shank 14 is discontinuous over a portion of the void space 22. The upper shank 14 spans approximately the full length of the shoe sole. The lower shank 18 extends only along the lower half of the void space 22. The lower shank 18 blends into the upper shank 14 at a forward end 98 and at an aft end 96 of the void space 22. This arrangement provides a variable stiffness or flexibility characteristic to the shoe sole.

Figure 16:
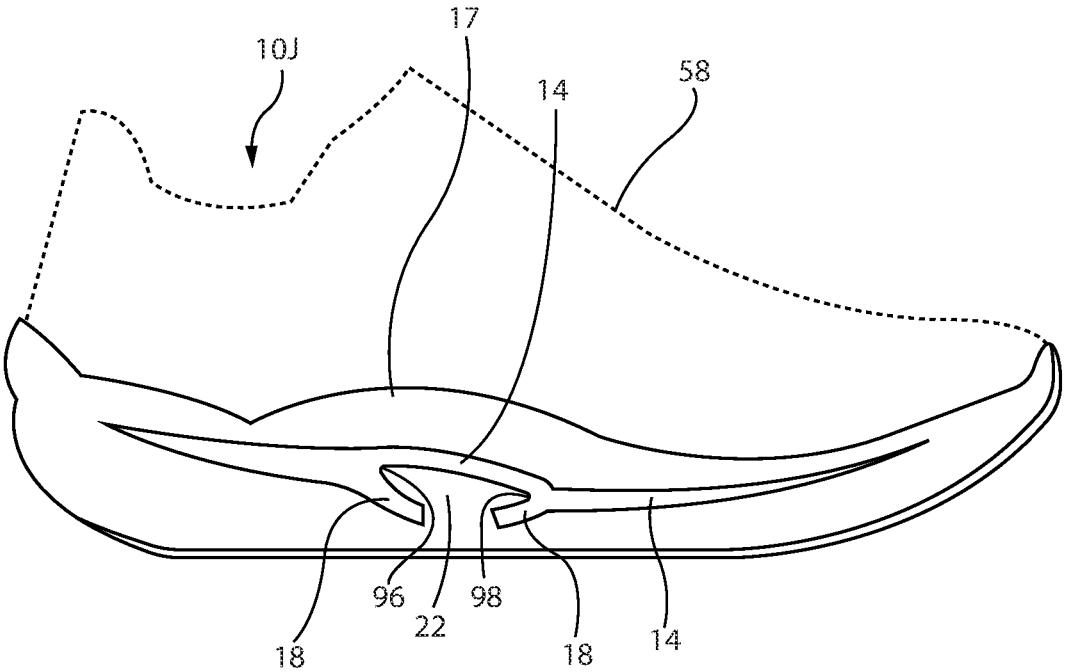
FIG. 16 is a representational side view of a tenth embodiment of the athletic shoe sole of the present invention having a single void space and an alternative shank configuration.

With reference to FIG. 16, a tenth embodiment 10J of the athletic shoe sole of the present invention is presented. In this embodiment, the void space 22 is formed in the midsole 17 and the shape of the void space 22 is defined by multiple, irregular curves. The upper shank 14 is disposed above the void space 22 and forms an upper boundary of the void space. The upper shank 14 spans approximately the full length of the shoe sole. The lower shank 18 extends only along the lower half of the void space 22 and is discontinuous under the void space. The lower shank 18 joins the upper shank 14 at the forward end 98 and aft end 96 of the void space 22. This arrangement provides a variable stiffness or flexibility characteristic to the shoe.

Figure 17:
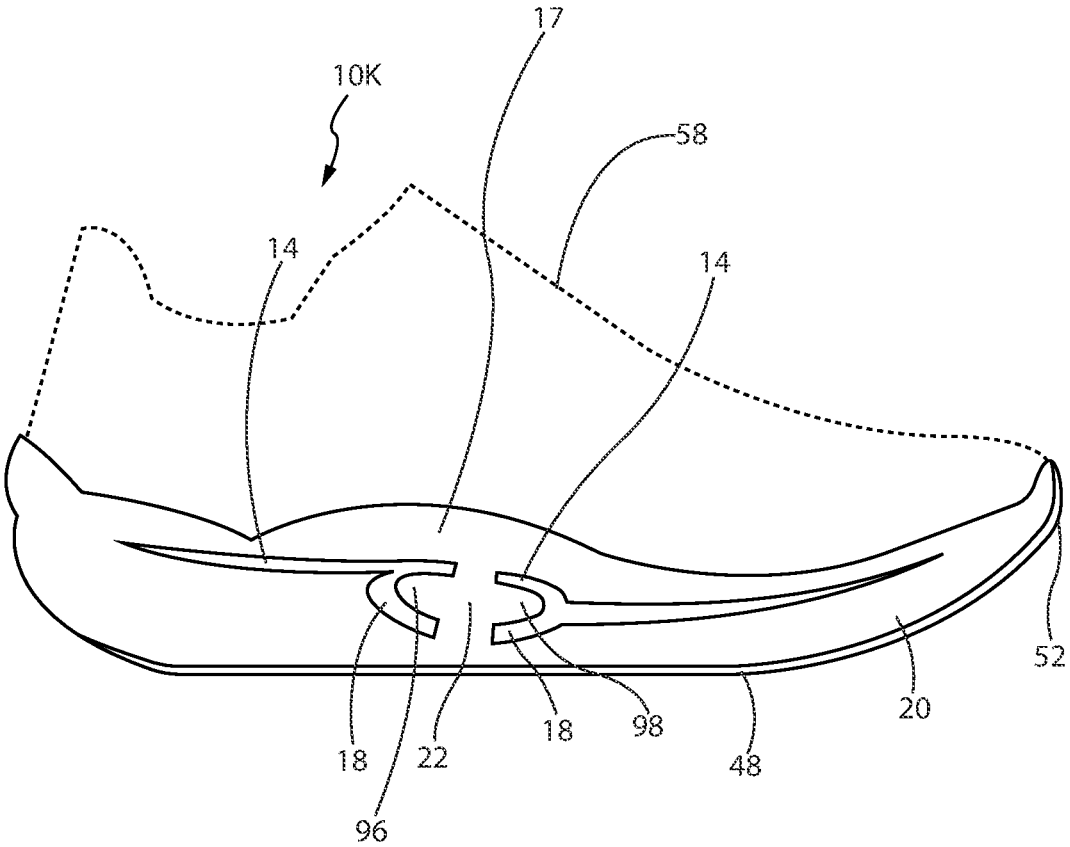
FIG. 17 is a representational side view of an eleventh embodiment of the athletic shoe sole of the present invention having a single void space and an alternative shank configuration.

With reference to FIG. 17, an eleventh embodiment 10K of the athletic shoe sole of the present invention is presented. In this embodiment, the void space 22 is formed in the midsole 17 and the shape of the void space is formed by multiple, irregular curves. The upper shank 14 is disposed above the void space 22 and forms a partial, upper boundary of the void space. The upper shank 14 spans approximately the full length of the shoe sole, but is discontinuous in the region immediately above the void space 22. The lower shank 18 extends only along the lower half of the void space 22 and is discontinuous under the void space. The lower shank 18 joins the upper shank 14 at the forward end 98 and aft end 96 of the void space 22. This arrangement provides a variable stiffness or flexibility characteristic to the shoe.

Figure 18:
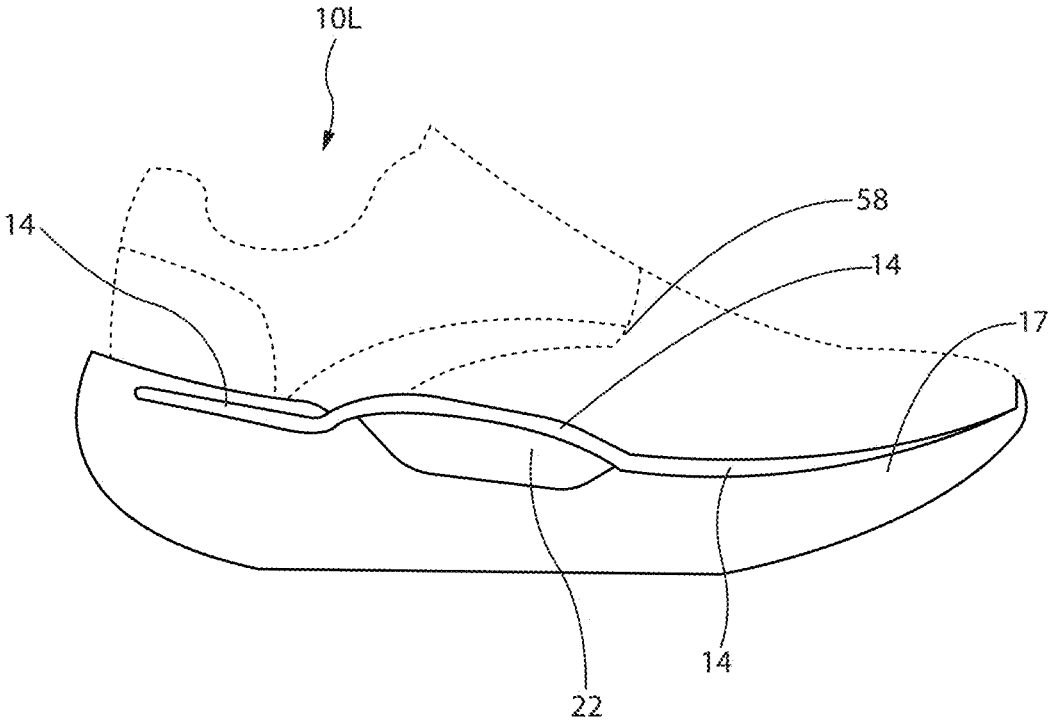
FIG. 18 is a representational side view of a twelfth embodiment of the athletic shoe sole of the present invention having a single void space and an alternative shank configuration.

With reference to FIG. 18, a twelfth embodiment 10L of the athletic shoe sole of the present invention is presented. In this embodiment, the shape of the void space 22 in the midsole 17 is formed by multiple, irregular curves. The upper shank 14 is disposed above the void space 22 and forms an upper boundary of the void space. The upper shank 14 spans approximately the full length of the shoe. A lower shank is not included in this embodiment. The twelfth embodiment 10L of the athletic shoe sole of the present invention provides substantial cushioning and is suitable for general athletic shoe use.

Figure 19:
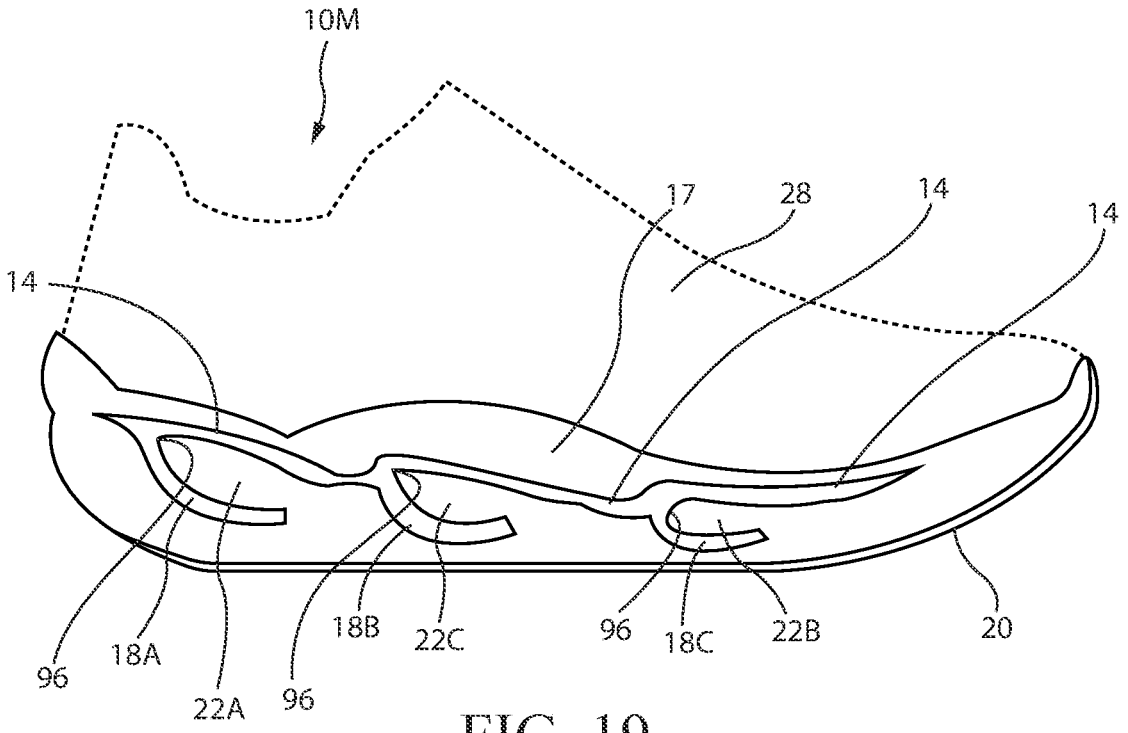
FIG. 19 is a representational side view of a thirteenth embodiment of the athletic shoe sole of the present invention having a triple void space configuration.

With reference to FIG. 19, a thirteenth embodiment 10M of the athletic shoe of the present invention shown in FIG. 10 is presented. The embodiment of FIG. 19 features three void spaces, i.e. the heel void space 22A disposed approximately under a wearer's heel, the forefoot void space 22B disposed approximately under the balls of a wearer's foot and an arch void space 22C disposed approximately under wearer's arch, each of which is formed in the midsole 17. The shape of each void space is defined by multiple, irregular curves. The void spaces are spaced so as to be positioned under a wearer's heel, arch area and the balls of the feet. The upper shank 14 is disposed above the void spaces and forms an upper boundary of each void space. The upper shank 14 spans approximately the full length of the shoe. The lower shank comprises an aft portion 18A, a center shank portion 18B and a forward portion 18C, where each lower shank portion extends only along the lower half of each void space and is discontinuous under each void space. Each of the lower shank portions 18A, 18B and 18C, join the upper shank 14 at an aft end 96 of each of the corresponding void spaces 22A, 22B and 22C. This arrangement provides a variable stiffness or flexibility characteristic to the shoe and provides energy return throughout the shoe and particularly as the heel and balls of a wearer's foot.

Figure 20:
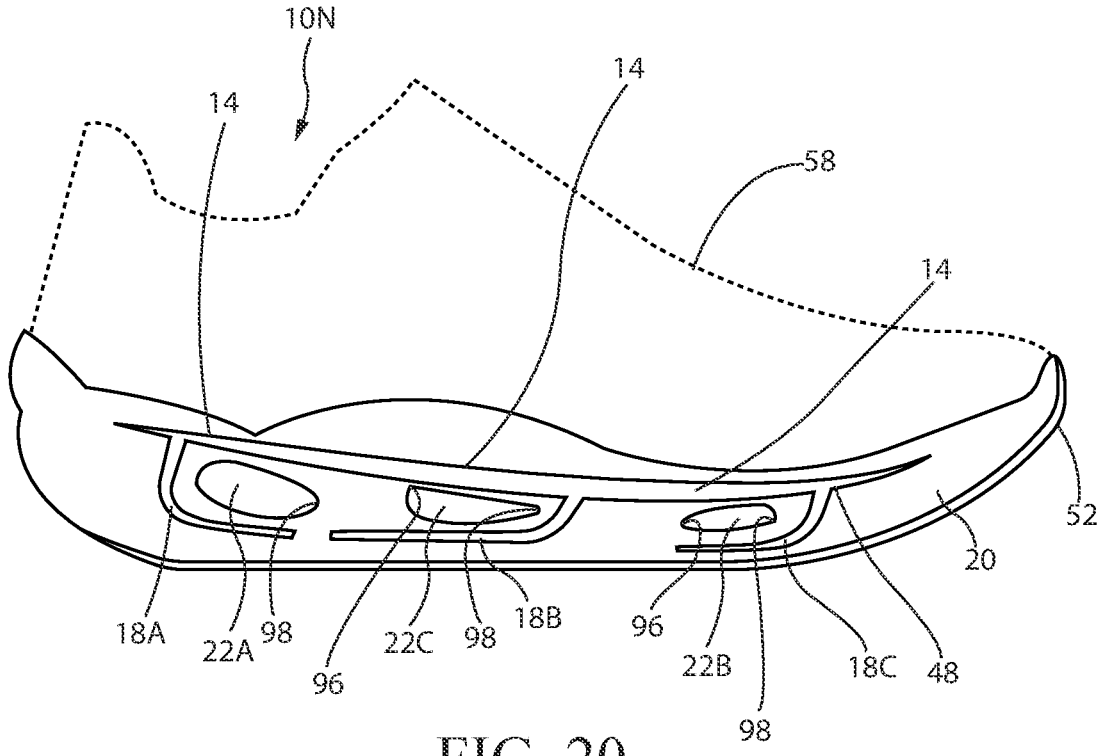
FIG. 20 is a representational side view of a fourteenth embodiment of the athletic shoe sole of the present invention having a triple void space configuration.

With reference to FIG. 20, a fourteenth embodiment 10N of the athletic shoe of the present invention shown in FIG. 10 is presented. In the embodiment shown in FIG. 20, three void spaces, i.e. the heel void space 22A, the forefoot void space 22B and the arch void space 22C are formed in the midsole 17 and the shape of each void space is defined by multiple, irregular curves. The void spaces are spaced so as to be positioned under a wearer's heel, arch area and the balls of the feet. The upper shank 14 is disposed above the void spaces and spans approximately the full length of the shoe. The lower shank comprises an aft portion 18A, a center portion 18B and a forward portion 18C, where each portion extends only along a portion of the lower half of each void space. The center portion 18B and forward portion 18C of the lower shank 18 join the upper shank 14 at the forward end 98 of void spaces 22B and 22C. The aft portion 18A of the lower shank joins the upper shank 14 at the aft end 96 of the aft void space 22A. This shank and void space configuration provides a variable stiffness or flexibility characteristic to the shoe and provides energy return throughout the shoe and particularly as the heel and balls of a wearer's foot.

In each of the embodiments the athletic shoe sole of the present invention, the midsoles or midsole is fabricated from ethylene-vinyl acetate ("EVA") foam or a like foam material. The upper shank may be fabricated from thermoplastic polyurethane ("TPU") or other moderately flexible plastic material. The lower shank may be fabricated from a relatively stiff, but still flexible carbon fiber or like material. It should be noted that both the upper and lower shanks could be made from the same material. In the exemplary embodiments, the lower shank is typically stiffer than the upper shank. In other embodiments however, it may be preferable for the upper shank to be stiffer than the lower shank.

In each of the embodiments of the athletic shoe sole of the present invention, the outsole 20 comprises a hard rubber outer layer typically having a lug pattern 44 on its external surface optimized to grip and provide traction with the ground.

A complete athletic shoe may be provided using any of the athletic shoe sole embodiments 10A to 10N by adding an upper 58 and, typically, an insole 60 (not shown). Suitable designs for shoe uppers and insoles are known in the art.

The foregoing detailed description and appended drawings are intended as a description of the presently preferred embodiment of the invention and are not intended to represent the only forms in which the present invention may be constructed and/or utilized. Those skilled in the art will understand that modifications and alternative embodiments of the present invention which do not depart from the spirit and scope of the foregoing specification and drawings, and of the claims appended below are possible and practical. It is intended that the claims cover all such modifications and alternative embodiments.

The invention claimed is:

1. A midsole assembly for an athletic shoe, the midsole assembly comprising:

an upper midsole, a lower midsole, a flexible upper shank, a flexible lower shank and a void space;

wherein the flexible upper shank and the flexible lower shank each extend from a heel region of the lower midsole to a forefoot region of the lower midsole wherein the flexible upper shank extends a majority of a total longitudinal length of the midsole assembly;

wherein the void space is defined by a concave lower surface portion formed in the flexible upper shank and a concave upper surface portion formed in the lower midsole, wherein the void space is entirely vacant;

wherein the lower midsole is disposed between the flexible upper shank and the flexible lower shank;

wherein the flexible upper shank abuts the upper midsole and has a convex portion that conforms with a concave lower surface portion of the upper midsole;

wherein the flexible lower shank is separated from the void space by the lower midsole;

wherein the flexible lower shank is stiffer than the flexible upper shank; and wherein the flexible upper shank and the flexible lower shank are both stiffer than the lower midsole.

2. The midsole assembly of claim 1, wherein the flexible upper shank is configured to flex between the upper midsole and the lower midsole during walking or running.

3. The midsole assembly of claim 1, further including an outsole disposed below the flexible lower shank.

4. The midsole assembly of claim 1, wherein the void space is disposed in an arch region of the lower midsole.

5. The midsole assembly of claim 1, wherein the void space spans the heel region and an arch region of the lower midsole.

6. The midsole assembly of claim 1, wherein the upper flexible shank is comprised of thermoplastic polyurethane, the lower flexible shank is comprised of carbon fiber and the upper midsole and the lower midsole are comprised of ethylene-vinyl acetate.

7. A midsole assembly for an athletic shoe, the midsole assembly comprising:

an upper midsole, a lower midsole, a flexible upper shank, a flexible lower shank and a void space;

wherein the void space is defined by a concave lower surface portion formed in the flexible upper shank and a concave upper surface portion formed in the lower midsole, wherein the void space is entirely vacant;

wherein the lower midsole is disposed between the flexible upper shank and the flexible lower shank;

wherein the flexible upper shank extends a majority of a total longitudinal length of the midsole assembly;

wherein the flexible upper shank includes a convex portion that abuts a concave lower surface portion of the upper midsole;

wherein the flexible lower shank is stiffer than the flexible upper shank; and wherein the flexible lower shank is separated from the void space by the lower midsole.

8. The midsole assembly of claim 7, further including an outsole disposed below the flexible lower shank.

9. The midsole assembly of claim 7, wherein the flexible upper shank and the flexible lower shank are both stiffer than the lower midsole.

10. The midsole assembly of claim 7, wherein the void space is formed in a heel region of the midsole assembly above the lower midsole.

11. The midsole assembly of claim 7, wherein the flexible upper shank extends from a heel region of the lower midsole to a forefoot region of the lower midsole.

* * * * *